US005595083A

United States Patent [19]

Shore

[11] Patent Number: 5,595,083

[45] Date of Patent: Jan. 21, 1997

[54] MODULAR ROLLING MILL

[75] Inventor: Terence M. Shore, Princeton, Mass.

[73] Assignee: Morgan Construction Company, Worcester, Mass.

[21] Appl. No.: 284,090

[22] Filed: Aug. 1, 1994

[51] Int. Cl.[6] ..... B21B 31/07

[52] U.S. Cl. ..... 72/249; 72/234

[58] Field of Search ..... 72/235, 239, 249, 72/250, 201

[56] References Cited

U.S. PATENT DOCUMENTS

| | | | |
|---|---|---|---|
| 3,587,277 | 6/1971 | Pigni et al. . | |
| 3,665,746 | 5/1972 | Eibe | 72/239 |
| 3,831,417 | 8/1974 | Ritter et al. | 72/249 |
| 4,038,855 | 8/1977 | Scheib . | |
| 4,182,148 | 1/1980 | Gilvar | 72/249 |
| 4,408,474 | 10/1983 | Hutzenlaub et al. | 72/249 |
| 4,537,055 | 8/1985 | Woodrow et al. . | |
| 4,706,479 | 11/1987 | Tominaga . | |
| 4,744,234 | 5/1988 | Poloni | 72/249 |
| 4,903,518 | 2/1990 | Kimura et al. | 72/249 |
| 4,907,438 | 3/1990 | Sasaki et al. . | |
| 5,144,828 | 9/1992 | Grotepass et al. . | |
| 5,152,165 | 10/1992 | Shore et al. . | |
| 5,247,820 | 9/1993 | Panaccione . | |

FOREIGN PATENT DOCUMENTS

| | | |
|---|---|---|
| 1874006 | 4/1963 | Germany . |
| 1602082 | 2/1970 | Germany . |
| 1527659 | 3/1970 | Germany . |
| 1910431 | 9/1970 | Germany . |
| 2845052 | 4/1980 | Germany . |

*Primary Examiner*—Daniel C. Crane
*Assistant Examiner*—Ed Tolan
*Attorney, Agent, or Firm*—Samuels, Gauthier, Stevens & Reppert

[57] ABSTRACT

A modular rolling mill has a plurality of rolling units arranged in succession on a mill pass line, each rolling unit having multiple pairs of mechanically interconnected work rolls. A plurality of gear reduction units is arranged in succession alongside the mill pass line, each gear reduction unit being driven by a drive motor. Couplings detachably connect at least some of the rolling units to two successive gear reduction units, with the remainder of the rolling units being connected to single gear reduction units.

8 Claims, 4 Drawing Sheets

MODULAR ROLLING MILL

BACKGROUND OF THE INVENTION

1. Field of the Invention

This invention relates generally to rolling mills, and is concerned in particular with the provision of a modular rolling mill for finish rolling long products such as round rods and bars as well as shaped products.

2. Description of the Prior Art

As disclosed for example in U.S. Pat. Nos. 4,537,055 (Woodrow et al) and 5,152,165 (Shore et al), current block type finishing mills are typically built with multiple roll stands supported on a common base and housed beneath a common cover. The roll stands are mechanically interconnected to and driven by a common drive which normally includes a single gear box and drive motor. The mill can be expanded to accommodate additional roll stands. However, both the customer and the mill builder must initially foresee that such expansion will be required, and then critical components including the base, gear box and drive motor must be sized and configured accordingly. This involves a considerable initial investment, the benefits of which will not be fully realized until expansion actually takes place, which may not be for several years.

A primary objective of the present invention is the provision of a finishing mill having a modular design which can be constructed initially to suit current rolling demands, and to which additional units can be added to accommodate future expansion.

A companion objective of the present invention is the provision of a modular finishing mill having rolling units which can be shifted rapidly onto and off of the mill pass line, thus providing a high degree of flexibility in accommodating different rolling schedules.

SUMMARY OF THE INVENTION

In accordance with the present invention, a modular rolling mill includes a plurality of rolling units arranged in succession along a mill pass line. Each rolling unit has multiple pairs of mechanically interconnected work rolls. Separately driven gear reduction units are arranged in succession alongside of the mill pass line. Couplings detachably connect input shafts of all but the first and last of the rolling units to the output shafts of two successive gear reduction units, with the input shafts of the first and last rolling units being similarly coupled to the output shafts of single gear reduction units. The number of rolling units and gear reduction units and associated drives can be selected initially to suit current requirements, and can be increased later to accommodate future expansion. The rolling units are preferably movable along a network of tracks which enables them to be quickly and efficiently shifted onto and off of the mill pass line.

BRIEF DESCRIPTION OF THE DRAWINGS

These and other objects and advantages of the present invention will be described in greater detail with reference to the accompanying drawings, wherein.

DETAILED DESCRIPTION OF PREFERRED EMBODIMENT

Figure 1:
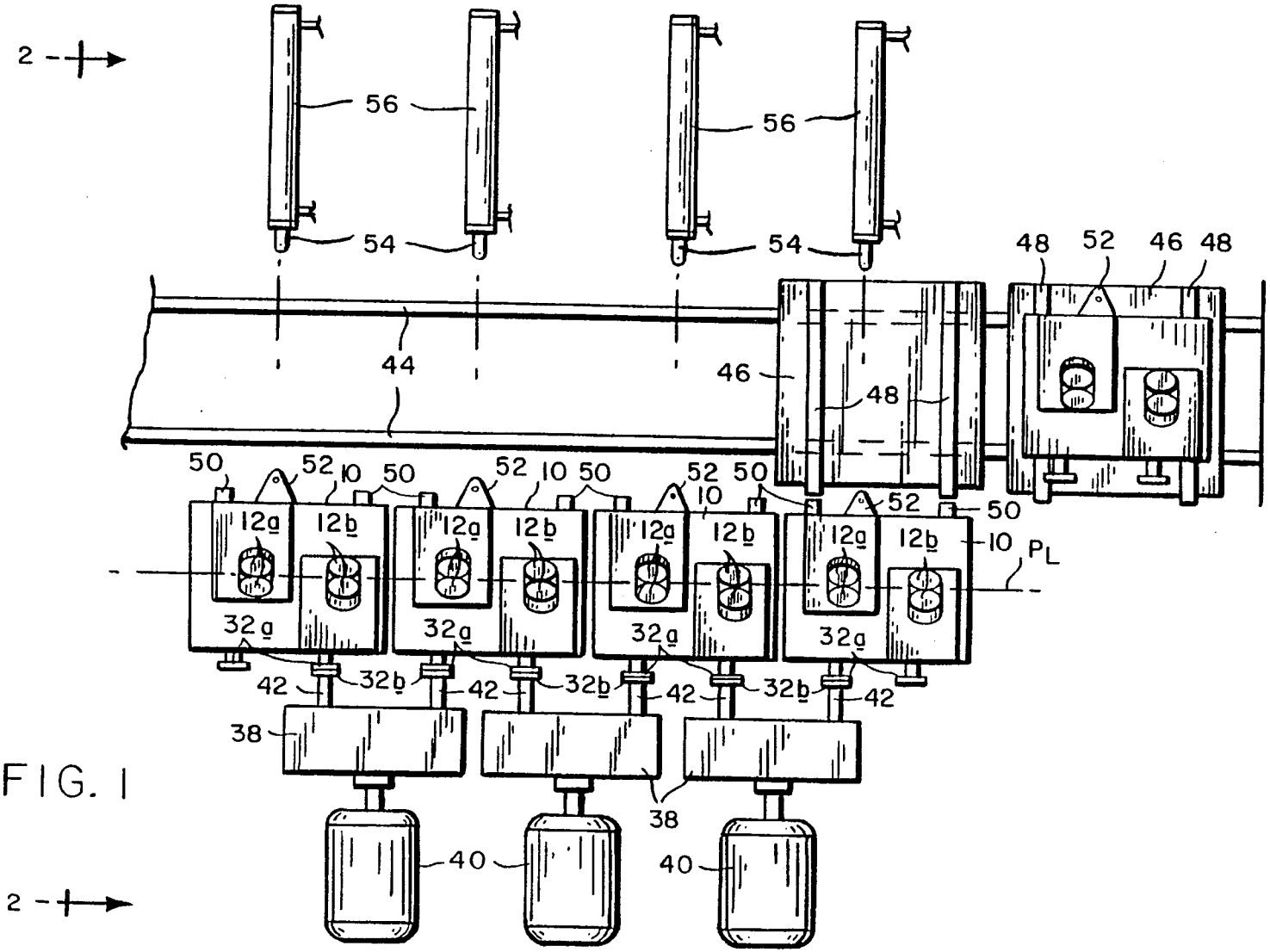
FIG. 1 is a horizontal plan view of a modular rolling mill according to the present invention, with the covers for the rolling units removed to better illustrate underlying components.
Figure 2:
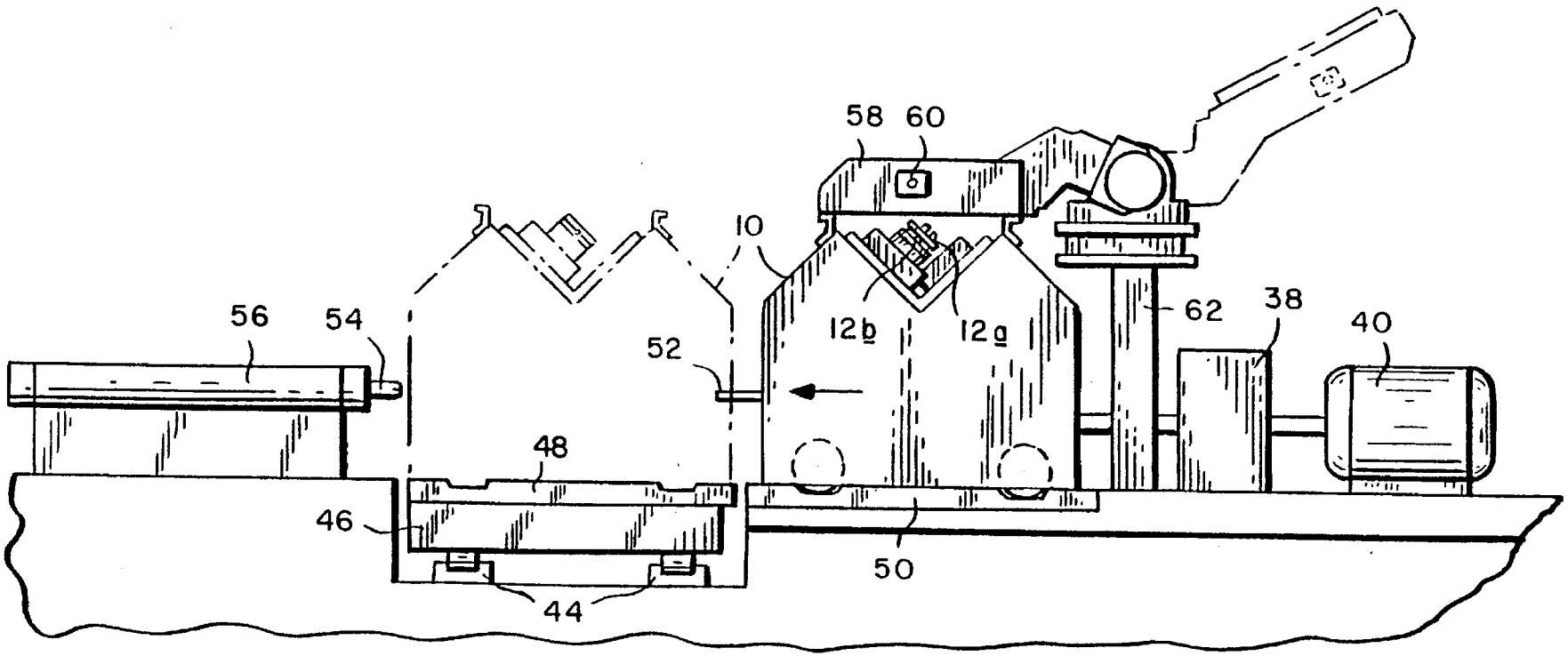
FIG. 2 is an end view of the mill taken generally along line 2—2 of FIG. 1.

With reference initially to FIGS. 1 and 2, a modular rolling mill is shown comprising plurality of rolling units 10 arranged in succession along a mill pass line $P_L$. Each rolling unit has multiple pairs of oppositely inclined grooved work rolls $\mathbf{12}_a$, $\mathbf{12}_b$. The work rolls $\mathbf{12}_a$, $\mathbf{12}_b$ may be configured to provide the typical high reduction oval-round pass sequence, or alternatively, they may be configured to provide light reduction sizing with a round-round pass sequence.

Figure 4:
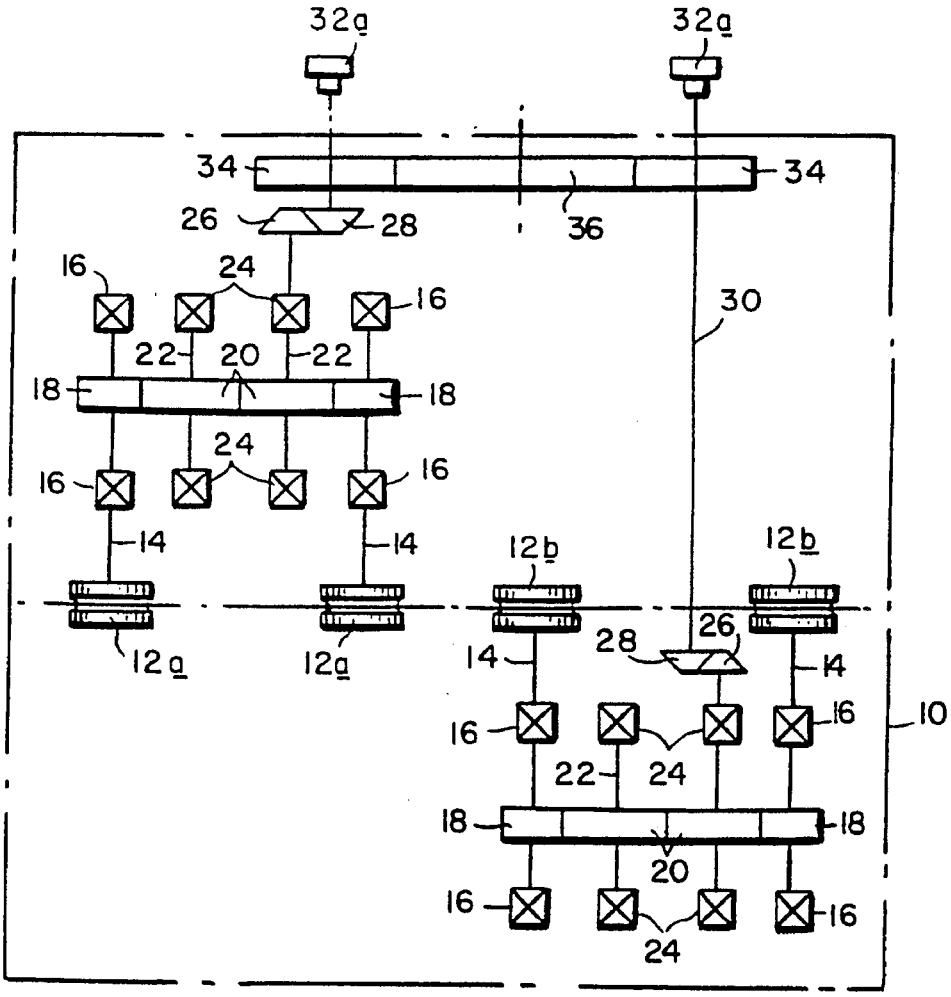
FIG. 4 is a diagrammatic illustration of the internal drive components of a typical rolling unit.

As can best be seen in FIG. 4, which is a diagrammatic illustration of the internal drive components of a typical rolling unit 10, the work rolls $\mathbf{12}_a$, $\mathbf{12}_b$ are mounted in cantilever fashion on the ends of roll shafts 14 rotatably supported by bearings 16. Gears 18 on the roll shafts mesh with intermeshed intermediate drive gear 20, the latter being carried on intermediate drive shaft 22 also journalled for rotation between bearing 24. One of the intermediate drive shafts is additionally provided with a bevel gear 26 meshing with a bevel gear 28 on an input shaft 30. The input shaft protrude from a "drive side" of rolling unit where they terminate in coupling halves $\mathbf{32}_a$.

The two input shafts 30 are additionally provided with gears 34 which mesh with a larger diameter intermediate gear 36. It will thus be seen that the work rolls $\mathbf{12}_a$, $\mathbf{12}_b$ are mechanically interconnected as a result of the interengagement of the gears 34 on the input shafts 30 with the intermediate gear 36.

Gear reduction units 38 are arranged in succession alongside the mill pass line $P_L$ facing the drive sides of the rolling units 10. Each gear reduction unit is individually driven by a drive motor 40 and is provided with a pair of output shafts 42 terminating and coupling halves $\mathbf{32}_b$. It will be understood that the coupling halves $\mathbf{32}_a$ on the input shafts 30 of the rolling unit 10 are designed to mate with the coupling halves $\mathbf{32}_b$ on the output shafts 42 of the gear reduction units 38 to provide readily separable drive connections, thereby accommodating ready engagement and disengagement of the rolling units 10 from associated gear reduction units 38.

Again with reference to FIG. 1, it will be seen that all but the first and last of the succession of rolling units 10 are coupled to two successive gear reduction units 38. The first and last of the rolling units are coupled respectively and exclusively to the first and last of the gear reduction units.

Tracks 44 extend in parallel relationship to the mill pass line $P_L$ along the side opposite to that occupied by the gear reduction units 38. Pallets 46 are mounted on the tracks 44 for movement in opposite direction parallel to the mill pass line. Each pallet has tracks 48 which extend in perpendicular relationship to the tracks 44, and which are arranged for alignment with tracks 50 extending beneath the mill pass line.

Each rolling unit 10 is suitably adapted as at 52 for connection to the piston rods 54 of piston-cylinder units 56. The units 56 may be selectively employed to laterally shift selected rolling units from the mill pass line onto empty pallets 46, the latter in turn being shiftable along the tracks 44 to make way for installation of spare or replacement rolling units carried on separate pallets.

Figure 3:
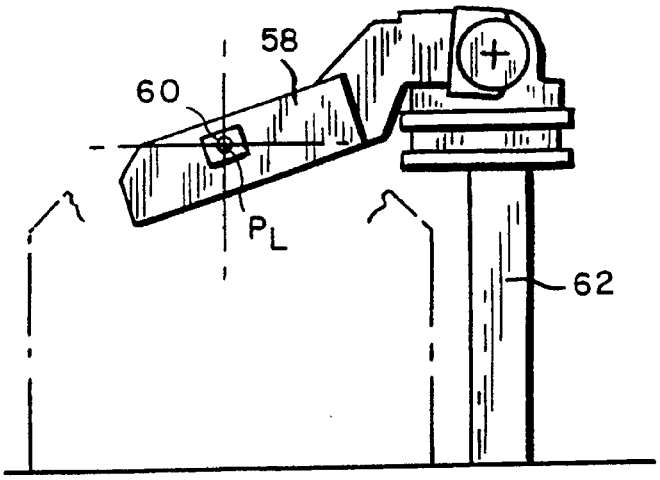
FIG. 3 is a partial end view from the same perspective as FIG. 2, showing a rolling mill cover adjusted to its lowermost position to serve as a guide in place of a rolling mill unit removed from the rolling line.

As can best be seen in FIG. 2, cover assemblies 58 overly and coact with respective rolling units 10 to enclose the work rolls $12_a$, $12_b$. Preferably, the cover assemblies are of the type described in U.S. Pat. No. 5,247,820 (Panaccione), the description of which is incorporated herein by reference. A guide trough 60 is integrally associated with each cover assembly 58. The cover assemblies are pivotally carried on support structures 62 and are typically adjustable from operative positions-supported on respective rolling units as indicated by the solid lines in FIG. 2 and fully open positions as indicated by broken lines in the same view. Additionally, when rolling units are "dummied", i.e., removed from the mill pass line and not replaced by other rolling units, the cover assemblies 58 may be lowered as illustrated in FIG. 3 to position the guide trough 60 on the mill pass line, thereby bridging the gap created by the dummied rolling unit.

If desired, the guide troughs 60 can include water nozzles for cooling the product as it passes across the gap created by the dummied rolling unit.

Figure 5A:
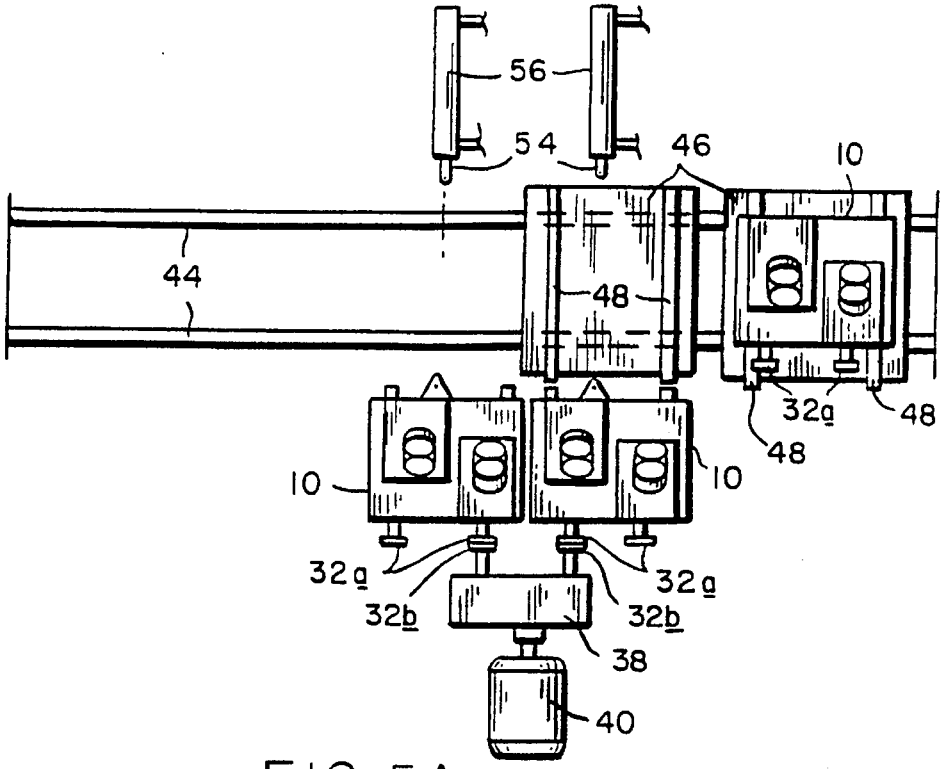
FIGS. 5A and 5B are plan views similar to FIG. 1 showing progressive stages during the development of the mill layout shown in FIG. 1.
Figure 5B:
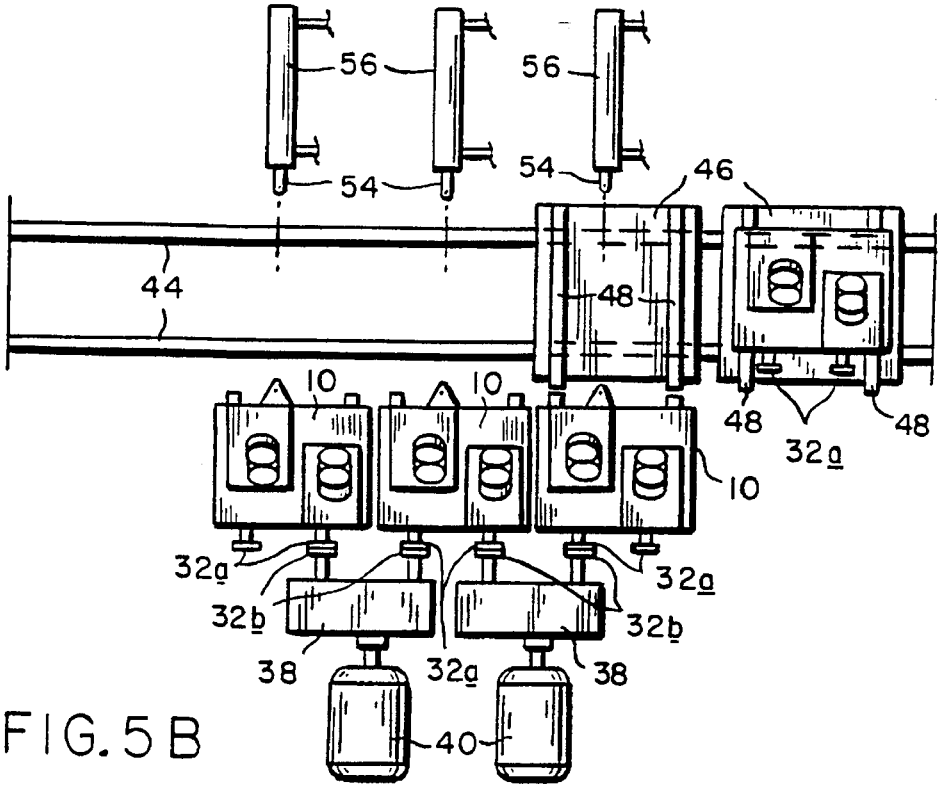

In light of the foregoing, it will now be appreciated by those skilled in the art that the present invention offers a number of significant advantages over the more conventional block-type finishing mills. To begin with, and with reference to FIG. 5A, and initial installation can comprise only two rolling units driven by a single gear reduction unit and associated drive motor. As mill capacity increases and/or a need arises for rolling a wider range of products, the capacity of the mill can be progressively increased by adding additional rolling units and gear reduction units, for example as illustrated in FIG. 5B. This expansion can take place gradually, and in step with gradually increasing requirements.

In addition to powering the rolling units 10, the gear reduction units 38 establish a vital mechanical interengagement between the successive rolling units. This occurs gradually as the capacity of the mill is expanded.

Flexibility is further enhanced by the ease with which rolling units can be removed from the mill pass line and replaced with either spare rolling units or guide assemblies. This flexibility enables the mill owner to easily accommodate a wide range of product sizes with minimal loss of valuable production time.

I claim:

1. A modular rolling mill comprising:

a plurality of rolling units arranged in succession on a mill pass line, each rolling unit having multiple pairs of mechanically interconnected work rolls;

a plurality of gear reduction units arranged in succession alongside said mill pass line, each gear reduction unit being driven by a drive motor; and coupling means for detachably connecting at least some of said rolling units to two successive gear reduction units and for connecting other of said rolling units to single gear reduction units.

2. The rolling mill of claim 1 wherein all but the first and last of the succession of rolling units are coupled to two successive gear reduction units.

3. The rolling mill of claim 2 wherein the first and last of the succession of rolling units are coupled respectively and exclusively to the first and last of said gear reduction units.

4. The rolling mill of claim 1 wherein said rolling units are staggered in the direction of said mill pass line with respect to said gear reduction units.

5. The rolling mill of claim 1 wherein said gear reduction units are arranged along one side of said mill pass line, and wherein said rolling units are removable to the opposite side of said rolling line.

6. The rolling mill of claim 5 wherein said rolling units are movably mounted on a network of tracks arranged to accommodate removal of selected rolling units from said rolling line and substitution of spare rolling units for the thus removed rolling units.

7. The rolling mill according to any one of claims 4–6 further comprising guide means for directing a product across any gaps created by the removal of rolling units from said mill pass line.

8. The rolling mill of claim 7 wherein said guide means includes means for cooling said product.

* * * * *